United States Patent [19]

Joyce et al.

[11] 4,049,113

[45] Sept. 20, 1977

[54] MERCHANDISE CONTAINER

[76] Inventors: James E. Joyce, 878 Darien, Rochester, Mich. 48063; Judy A. Zeller, 5559 Westwood Lane, Birmingham, Mich. 48010

[21] Appl. No.: 735,910

[22] Filed: Oct. 26, 1976

[51] Int. Cl.[2] ..... B65D 5/50; B65D 5/52

[52] U.S. Cl. ..... 206/44 R; 206/45.16; 206/804

[58] Field of Search ..... 206/44 R, 45.16, 804

[56] References Cited

U.S. PATENT DOCUMENTS

| | | | |
|---|---|---|---|
| 2,051,512 | 8/1936 | Bergavist | 206/45.16 |
| 3,664,494 | 5/1972 | Mergens | 206/44 R |

*Primary Examiner*—George T. Hall
*Attorney, Agent, or Firm*—Krass & Young

[57] ABSTRACT

A merchandise shipping and display container system comprising an outer carton of cardboard or the like, a plurality of trays for the merchandise stacked on top of one another within the carton or alternatively, a plurality of layers of stacked boxed merchandise, and one or more intermediate members which wrap collectively around the stacked trays within the carton. The wrappers have fold-over top flaps with handle holes which register with additional holes in the sides of the wrapper or in the flap to form a reinforced handle when raising the stacked trays or merchandise out of the carton. The wrappers may alternatively have no flaps and only one handle hole in each side of each wrapper when the weight of the merchandise so warrants. Additionally, one or more of the wrappers is convertible to a display sign which is supported on top of a telescoping member which adjusts the height of the sign as merchandise on the display is used. The trays are designed to support the telescoping member.

28 Claims, 8 Drawing Figures

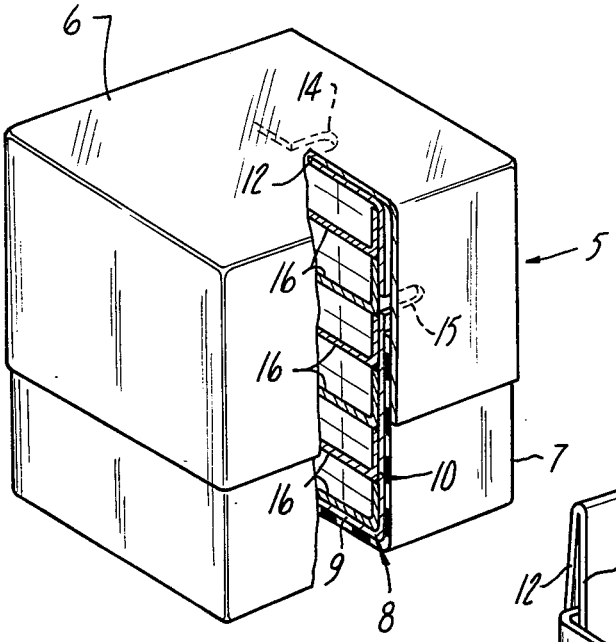
Fig-1
Fig-2
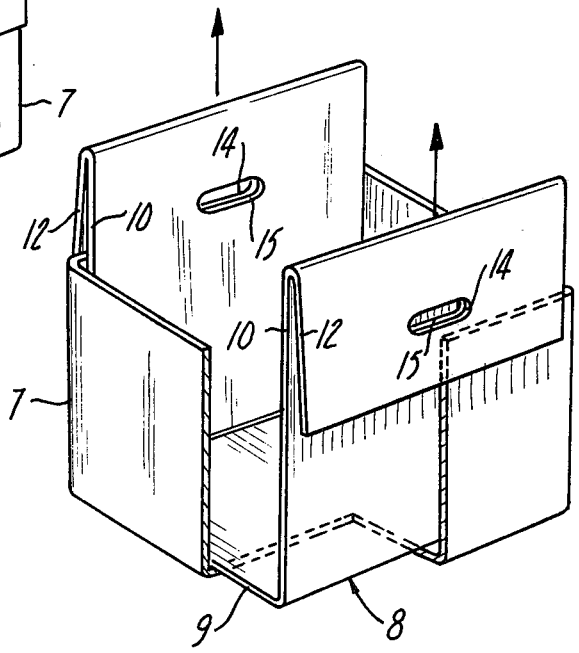
Fig-3
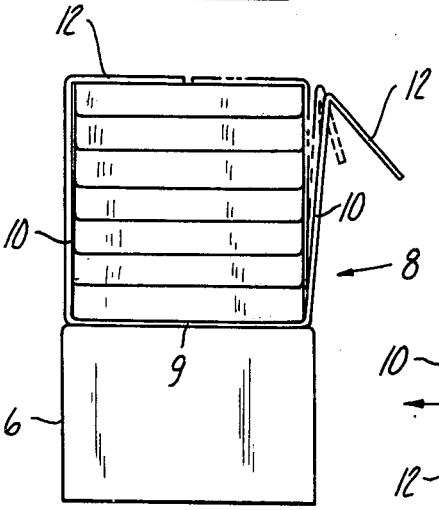
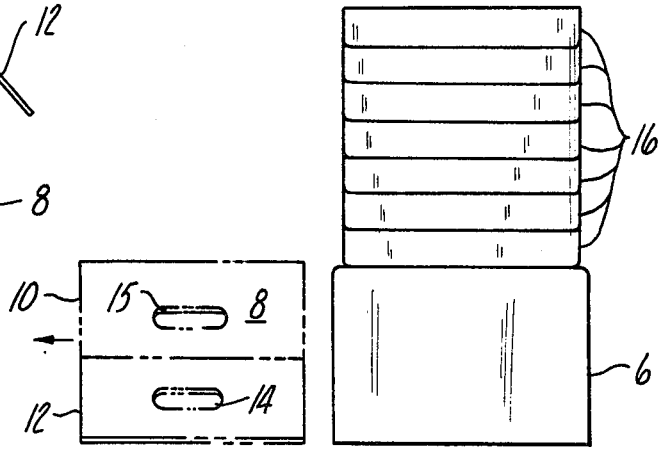
Fig-4

MERCHANDISE CONTAINER

BACKGROUND OF THE INVENTION

1. Field of the Invention

The invention relates to merchandise containers that can be used for storage, shipment and display purposes and a method for packing and unpacking such a container.

2. Description of the Prior Art

Prior art shipping containers for various merchandise typically involved little more than a cardboard box, some internal packing material, and sealing tape. Such a combination, although satisfactory from the standpoint of the basic shipping requirements, gives little assistance to the recipient who must unpack the merchandise and put it on display at a point of purchase. Merchandise which is prepackaged into individual boxes or the like must be dumped out in bulk. Moreover, the container must usually be discarded as it is either destroyed in unpacking or has no other significant utility. The display function typically involves moving the merchandise from the container to a stand or shelf.

SUMMARY OF THE PRESENT INVENTION

The present invention comtemplates a merchandise container for receiving a plurality of individually prepackaged or containerized items of merchandise in such a manner as to permit rapid and orderly unpacking, as well as to facilitate the display of the merchandise and the further use of the container.

In general, these objectives are accomplished in a shipping container and display system for merchandise comprising an outer carton of cardboard or the like, a plurality of trays for the merchandise stacked on top of one another or alternatively, a plurality of layers of stacked, boxed merchandise within the carton, and one or more lift wrappers which collectively enclose the stacked trays within the carton. The collective height of the vertical portions of the wrappers substantially fill the carton. The lift wrappers have fold-over flaps with handle holes which register with either additional holes in the sides of the wrapper or additional holes in the flap itself to form a reinforced handle when raising the stacked trays out of the carton. The wrappers may alternatively have no flaps and only one handle in each side of each wrapper when the weight of the merchandise so warrants.

In the preferred embodiment, the carton comprises upper and lower interfitting parts. One of the preferred lift wrappers performs a dual function; first, in its fully assembled configuration, the uppermost portion of the wrapper folds over the top of the stack of trays and merchandise, providing protection thereto, the combined height of the stack of trays being greater than the height of the bottom part of the carton and less than the height of the side portion of the lift wrapper. Second, upon removal of the top portion of the outer carton, the flaps fold over, forming laterally opposed, reinforced handles in the wrapper which facilitate removal of the contents in one motion. The wrapper occupies a minimum of volume within the carton, thereby not reducing its carrying capacity appreciably. Additionally, removal of the merchandise with the wrapper reduces the wear-and-tear on the carton.

In an alternative configuration of the preferred embodiment, the same two part carton is employed, however two lift wrappers are used, each enclosing approximately one-half of the stack of merchandise trays. The top wrapper performs the same dual function as described above. The lower lift wrapper has a bottom, and lateral sides that terminate in integral flaps as does the top wrapper. Additionally, the flaps of the lower wrapper are divided by a fold line allowing each flap to be folded in two, forming laterally opposed reinforced handles in the wrapper facilitating removal of that portion of the contents within that wrapper in one motion.

In another alternative embodiment of the invention, each light wrapper comprises only a bottom and opposed side portions, having a single lift handle aperture within each side portion of each wrapper. This embodiment is intended for use with relatively light-weight merchandise only.

Although not illustrated, in the preferred embodiment employing a plurality of layers of stacked boxed merchandise, an optional feature would be the use of horizontally orientated planar spaces between each tier of boxes. Each spacer is dimensionally substantially the same size as the stack of boxes when viewed in horizontal cross-section. The spacers are formed of cardboard or the like and are intended to add cohesiveness to the stack after its removal from the carton.

The present invention also contemplates a method for using such a merchandise container for display purposes, as well as for shipment and storage, comprising removing the upper part of the carton and placing it in the location where the display is desired. By rotating each flap of the lift wrapper outwardly about its integral hinge, laterally opposed reinforced handles are formed. In one motion, the wrapper containing the stack of merchandise trays may be removed from the lower part of the carton and placed as a unit on and in substantial alignment with to top surface of the upper part of the carton. The wrapper can then be removed from beneath the stack of merchandise trays by sliding the wrapper horizontally while maintaining the orientation of the stack of trays to the upper part of the carton. The wrapper can then be replaced into the lower part of the carton, as can the empty trays (or alternatively, spacers) as the merchandise on each tray (or the boxed merchandise on each tier) is sold or used. Finally, when all the merchandise is disposed of, replacement of the upper part of the carton onto the lower part containing the lift wrapper and the empty trays will complete the method, allowing the container to be reused. This method of packing and unpacking merchandise allows the container to be used in the several modes discussed above as well as promoting its reuse.

An additional application can be achieved by providing a rearwardly opening slot in each merchandise tray and providing one or more of the lift wrappers with an advertising message and a set of locking tabs and slots in appropriate places so that those wrappers can be reconfigured into signs. A tubular telescoping sign support member is supplied within the packed container for each sign. Each sign support member comprises two interfitting tubes of cardboard or the like, the inside diameter being slightly larger than the outside diameter of the other to allow the larger to freely slide over the smaller. The smaller tube is placed within a vertical channel defined by the rearwardly opening slots in the stack of trays, its lowermost end being supported by the top portion of the carton that is now serving as a display base. The larger tube is placed over the top of the smaller tube within the channel and is stopped by a C-shaped clip or alternatively by a plug, both of which are supplied in the fully packed container, which provide a vertical height adjustment. Finally, the sign is placed upon the top of the larger tube to supply an advertising message. As the merchandise is depleted, the sign can be adjusted downwardly or will so adjust automatically depending upon the configuration employed to maintain display stability and attractiveness. Although only one sign and support member is illustrated, it is the contemplation of this invention that two or more could be used on the same or adjoining stacks of merchandise trays. Additionally, a standard one-piece outer carton can be alternatively used during shipment, then placed on its side to function as a display base, facilitating two or more adjoining stacks of merchandise trays and signs.

In the preferred embodiment of the invention which will subsequently be disclosed in detail, the lift wrapper is constructed of corrugated cardboard and the integral hinges are scored lines in the cardboard.

The preferred embodiment illustrates the use of a stack of six rectangular merchandise trays, but it is the contemplation of this invention that more or fewer could be used, as well as other configurations, depending upon the nature of the merchandise. Additionally, the relative heights of the upper and lower parts of the outer carton can vary without affecting the spirit of the invention. Only the aesthetic appearance of the display will be affected by such variations.

Other objectives and advantages of the present invention will be made apparent from the following detailed description of a preferred embodiment of the invention. The invention makes reference to the accompanying drawings.

BRIEF DESCRIPTION OF THE DRAWINGS

FIG. 1 is a perspective view with a cut-away section of the preferred embodiment showing the fully assembled carton, single lift wrapper and merchandise trays;

FIG. 2 is a perspective assembly drawing with a cut-away section of the lower part of the carton and the lift wrapper;

FIG. 3 is a front plan view of the lift wrapper and stacked merchandise trays which have been removed from the lower part of the carton and are resting upon the top surface of the upper part of the carton, representing the preferred display method before the lift wrapper is removed;

FIG. 4 is a side plan view of the subject matter of FIG. 3 additionally showing the removal of the lift wrapper;

DETAILED DESCRIPTION OF THE SPECIFIC EMBODIMENT

Figure 5:
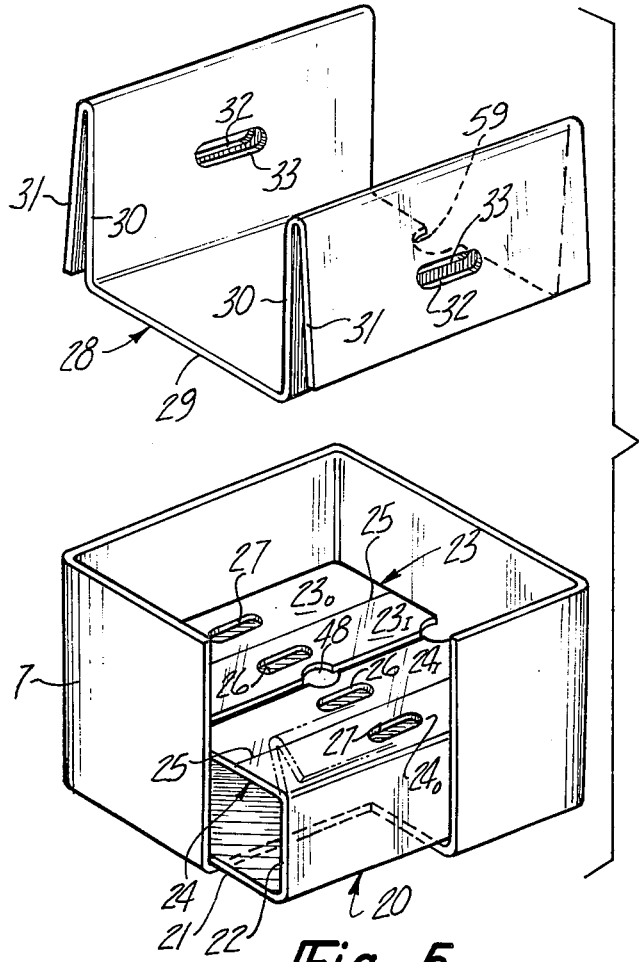
FIG. 5 is a perspective view with cut-away section of an alternative embodiment employing two lift wrappers, the upper wrapper being removed to illustrate detail.

Referring to FIG. 1, a merchandise container constituting a preferred embodiment comprises a substantially cubical outer carton 5 having an upper part 6 and a lower part 7 which mate with each other, the upper part 6 being slightly larger in horizontal cross-section than the lower part 7 so as to fit over the lower part 7 in telescopic relation, the two parts having the same relative heights.

Nested within the lower part 7 of the carton 5 is a lift wrapper 8 which is formed of sheet material, comprising a bottom portion 9, and two vertical, laterally opposed side portions 10. Both side portions 10 terminate in integrally hinged flaps 12. The side portions 10 of the lift wrapper 8 are substantially taller than the lower part 7 of the outer carton 5. When the flap 12 on each side portion is positioned inwardly and normal to the side portion 10, as illustrated, it serves as a protective top flap. When the flap 12 on each side portion 10 is positioned outwardly and substantially parallel to the side portion 10, the flap 12 and the side portion 10 cooperate with each other and form a double thickness for handling adjacently below the hinge line. Each flap 12 and side portion 10 has a horizontally elongated aperture 14 and 15 respectively. The two apertures 14 and 15 are oriented so as to register when the flap 12 on the side portion 10 is fully rotated outwardly. A plurality of open top merchandise trays 16 are disposed in a stacked relationship with one another within the volume enclosed by the lift wrapper 8. The combined height of the stack of trays 16 is greater than that of the lower part 7 of the carton 5 and slightly less than the height of the side portion 10 of the lift wrapper 8. Each tray 16 is interchangeable with the others and is capable of supporting individually boxed or loose items of merchandise while in the stacked position. In horizontal cross-section, each tray is so dimensioned as to nest within the lift wrapper 8 when the lift wrapper 8 is disposed within the lower part 7 of the carton 5.

Referring to FIG. 2, the lift wrapper 8 is disposed within the lower part 7 of the carton 5. The flaps 12 are in their outwardmost position, being substantially parallel to their respective integral side portions 10 thereby registering the flap apertures 14 and the side portion apertures 15. When the flaps 12 are in the illustrated position, double thickness reinforced handles are formed allowing removal of the lift wrapper 8 and the stack of merchandise trays from the lower part 7 of the carton 5 in one motion by gripping the two handles and lifting upwardly.

Referring to FIG. 3, a preferred method for using a merchandise container for display purposes comprises removing the upper part 6 of a fully assembled merchandise container and locating it, top-side-up where the display is desired. The lower part 7 of the carton 5 could be used as a substitute if upper part 6 were damaged or unusable. Each flap 12 of the lift wrapper 8 is rotated from its packed position outwardly until the flap 12 is substantially parallel with side member 10 of the lift wrapper 8 thereby bringing into alignment the two apertures 14 and 15, forming handles. By gripping the two handles and lifting upwardly one removes the lift wrapper 8 and the stack of merchandise trays 16 nested therein from the lower part 7 of the carton 5. The lift wrapper 8 and the trays 16 stacked therein may then be placed upon and in substantial alignment with the uppermost surface of the upper part 6 of the carton 5.

Referring to FIG. 4, the display is completed by sliding the lift wrapper 8 horizontally from under the stack of merchandise trays 16 which contain the merchandise while maintaining the orientation of the stack of trays 16 vis-a-vis the upper part 6 of the carton 5. Upper carton part 6 is preferably decorated by printing with suitable advertising indicia.

Referring to FIG. 5, a merchandise container constituting an alternative embodiment comprises the same substantially cubical outer carton 5 and stack of merchandise trays 16 as does the preferred embodiment described above. Nested within the lower part 7 of the carton 5 is a lower lift wrapper 20 which is formed of sheet material, comprising a bottom portion 21, and two vertical, laterally opposed side portions 22. Both side portions 22 terminate in integrally hinged flaps 23 and 24. Both flaps are divided by fold lines 25 which are substantially parallel to the hinge line joining the flaps 23 and 24 and their respective side portions 22. The fold lines divide each flap into two (inner and outer) panels $23_I$ and $23_O$ and $24_I$ and $24_O$. In the fully assembled configuration, the inner and outer panels of each flap 23 and 24 are substantially in line horizontally and serve to protect the contents enclosed therein. The vertical height of the side portion 22 of the wrapper 20 is substantially less than the height of the lower part 7 of the carton 5 and slightly greater than the cumulative height of that portion of the above described merchandise trays 16 that are stacked within. When the inner panel $23_I$ and $24_I$ of each flap 23 and 24 is rotated outwardly about the fold line 25 they became substantially parallel to their respective outer panels $23_O$ and $24_O$ and cooperate with each other to form a double thickness for handling adjacently outwardly from the fold lines 25. Each flap 23 and 25 has a pair of horizontally elongated apertures 26 and 27 which straddle and are equidistant from the fold line 25. The apertures 26 and 27 are oriented so as to register when the inner panels $23_I$ and $24_I$ are fully rotated outwardly and become substantially parallel with their respective outer panels $23_O$ and $24_O$. When oriented so as to register their respective apertures 26 and 27 each flap 23 and 24 is then rotated outwardly about the hinge point between the flaps 23 and 24 and their respective side portions 22 to an angle intermediate of the inward horizontal assembled position and true vertical, allowing the user to reach within the bottom part 7 of the carton 5 and grasp the folded flaps 23 and 24. When the flaps 23 and 24 are so positioned, double thickness reinforced portion handles are formed allowing removal of the lift wrapper 20 and the merchandise trays 16 therein from the lower part 7 of the carton 5 in one motion by gripping the two handles and lifting upwardly.

The alternative embodiment comprises a second wrapper 28 which is formed of sheet material comprising a bottom portion 29 and two vertical, laterally opposed side portions 30. Both side portions 30 terminate in integrally hinged flaps 31. The side portions 30 of the top lift wrapper 28 combined with the side portions 22 of the lower lift wrapper 20 are cumulatively substantially taller than the lower part 7 of the outer carton 5. When the flap 31 on each side portion 30 is positioned inwardly and normal to the side portion 30, it serves as a protective top flap. When the flap 31 on each side portion 30 is positioned outwardly and substantially parallel to the side portion 30, the flap 31 and the side portion 30 cooperate with each other and form a double thickness for handling adjacently below the hinge line. Each flap 31 and side portion 30 has a horizontally elongated aperture 32 and 33 respectively. The two apertures 32 and 33 are oriented so as to register when the flap 31 on the side portion 30 is fully rotated outwardly. The balance of the open top merchandise trays 16 not enclosed in the lower wrapper 20 are disposed in a stacked relationship with one another within the volume enclosed by the lift wrapper 28. The combined height of the side portion 22 of the lift wrapper 20 and the stack of trays 16 disposed within wrapper 28 is greater than that of the lower part 7 of the carton 5 and slightly less than cumulative height of the side portion 22 of the wrapper 20 and the side portion 30 of the wrapper 28. A U-shaped relief 59, whose function will be discussed below in detail, is centrally located on the rearwardmost edge of the bottom 29 of the wrapper 28, opening to the rear.

In the fully assembled configuration, the bottommost surface of the bottom 29 of the wrapper 28 rests upon the uppermost surface of the flaps 23 and 24 of the wrapper 20. The flaps 31 of the wrapper 28 are rotated inwardly and are normal to their respective side portions 30 and underlie the lowermost surface of top part 6 of the carton 5. Part of the stack of trays 16 are enclosed by and nest within wrapper 20 and the rest of the stack of trays 16 are enclosed by and nest within the wrapper 28. Although not illustrated, it is within the contemplation of this invention that certain merchandise may be packaged in such a way as to obviate the need for trays 16. In such a case, the trays 16 are replaced by stacked, boxed merchandise and the container functions equally well as herein described.

Figure 6:
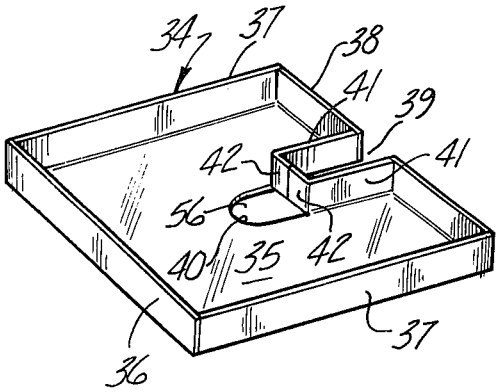
FIG. 6 is a perspective view of a merchandise tray which has been modified with a rearwardly opening slot for use in a display.

Referring to FIG. 6, an alternative typical merchandise tray 34 for display application comprises a bottom 35, and integral front panel 36, two side panels 37 and rear panel 38. A slot 39 in the bottom 35 of the tray 34 opens to the rear and extends inwardly, terminating in a semicircle 40, the diameter of which being equal to the lateral width of the slot, and the center of which substantially corresponds with the center of the bottom 35. Two parallel integral vertical slot support panels 41 of the same height as the other panels 36, 37, and 38 run inwardly from the rear panel 38 along the slot 29 and terminate in integrally hinged sign post retaining tabs 42. The purpose of this structure will be detailed below. The trays 34 are substantially identical and can be interchangeably stacked in a vertical array.

Figure 7:
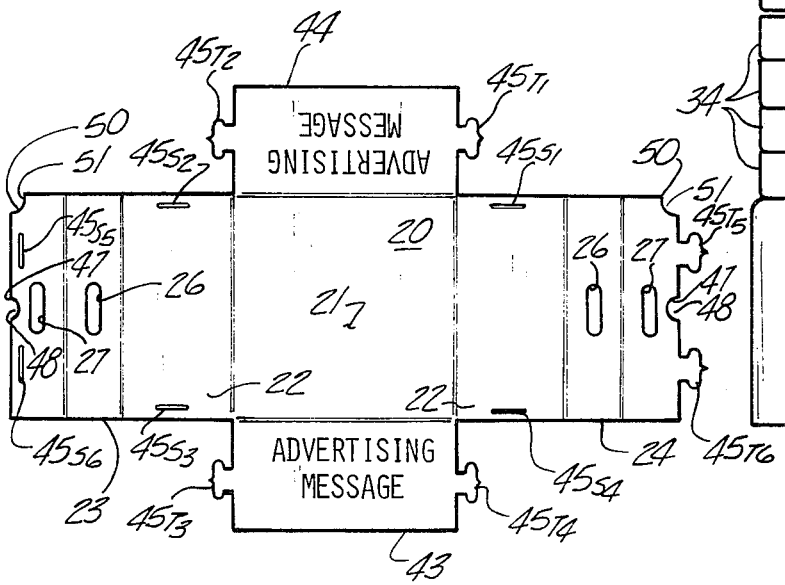
FIG. 7 is a plan view of an unfolded lower wrapper that is suitable for reconfiguration into a display sign.

Referring to FIG. 7, when a full display configuration of the container with two lift wrappers is desired, the lower wrapper 20 is modified from that version described in FIG. 5. Front and rear portions 43 and 44 are added to the wrapper 20 being integrally hinged along the forwardmost and rearwardmost horizontal edges of the bottom 21 of the wrapper 20. The front and rear portions 43 and 44 are substantially the same dimensions as the side portions 22 of the wrapper 20. An appropriate advertising message can be printed on any or all of the side, front and rear portions of the wrapper 20. By means of a set of locking tabs and slots $45_T$ or $45_S$, the wrapper 20 can be reconfigured after unpacking of the container to form a rectangular box type display sign 46. The bottom 21 of the lift wrapper 20 becomes the top of the sign 46. The flaps 23 and 24 of the lift wrapper 20 become the bottom of the sign 46. A semi-circular relief 47 is provided centrally along the edge of the free end of each flap 23 and 24. When assembled in the sign 46 configuration, the two reliefs 47 cooperate to form a sign post support aperture 48. The function of the sign in the display will be described in detail below. Two J-shaped reliefs 50 are formed in the rearwardmost corner along the free edge of the flaps 23 and 24 of the wrapper 20. When the wrapper 20 is used as a wrapper, the reliefs 50 cooperate to form a U-shaped channel 51 the function of which will be described in detail below. The sign post support aperture 48 has no function in the fully assembled shipping configuration, and the U-shaped channel 51 has no function in the fully assembled display configuration.

Figure 8:
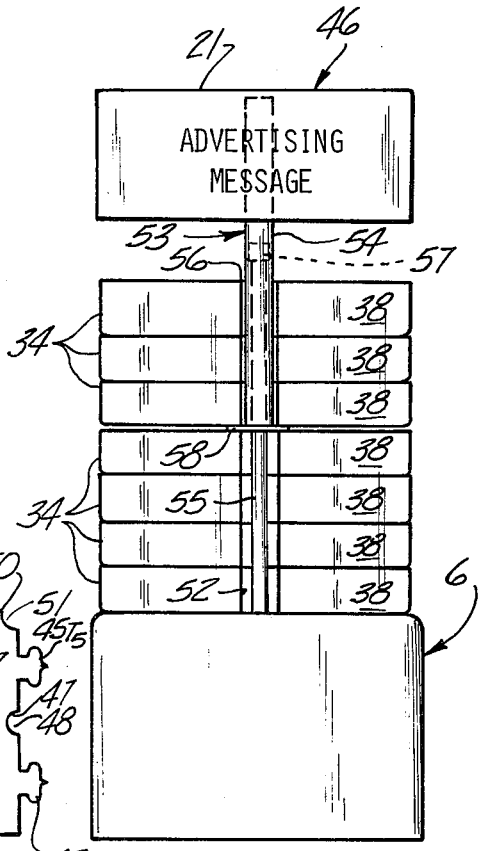
FIG. 8 is a rear plan view of the fully assembled display employing the sign from FIG. 7.

Referring to FIG. 8, the fully deployed display configuration of the container is illustrated as viewed from the rear. The stack of merchandise trays 34 rest upon the uppermost surface of the top part of the carton 5. The slot 39 of each of the trays 34 are in substantial alignment, forming a vertical channel 52. A tubular telescoping sign support member 53 is supplied in the packed merchandise container and is made up of two elongated cylindrical interfitting tubes 54 and 55 of cardboard or the like, the inside diameter of one 54 being slightly larger than the outside diameter of the other 55 to allow the larger 54 to freely slide over the smaller 55. The vertical channel 52 is slightly wide than the outside diameter of tube 54. The vertical channel 52 when viewed downwardly has a generally elongated U-shaped section which opens to the rear of the merchandise trays 34. By rotating the sign post retaining tabs 42 inwardly, a D-shaped aperture 56 is formed. The sign support member 53 is installed by sliding the smaller tube 55 downwardly into the D-shaped aperture 56 so that its bottommost end is vertically supported by the uppermost surface of the top part 6 of the container 5. The post 55 is loosely supported by the sides of the channel 52 and the tabs 42. A plug 57 is placed in the upper end of the larger tube 54 as a stop to limit the downward displacement of the tube 54 to the point where the upper end of the smaller tube 55 abuts the lower surface of the plug 57. A planar U-shaped sign height adjustment stop 58 varies the height of the sign as the merchandise is depleted. The inside width of the U-shaped stop 58 is slightly greater than the outside diameter of the smaller tube 55 but less than the outside diameter of the larger tube 54. The height of the upper telescoping tube 54 can be adjusted above that allowed by the plug 57 by raising the upper (larger) tube, horizontally orienting the stop 58 with its opening forward, and forwardly from the rear inserting the stop 58 around the smaller tube 55 between the bottommost surface of the bottom 35 of a tray 34 and the upper edge of the rear panel 38 of the tray 34 immediately below. The stop 58 is thereby vertically supported between the two trays and acts as a flange upon the top surface of which rests the bottom end of the upper tube 54. The lower lift wrapper 20 which has been reassembled into a sign 46 is then placed on top of the upper end of the larger tube 54. The upper end of the tube 54 thereby penetrating the aperture 48 in the sign bottom and abutting against the lowermost surface of the sign top 21. The sign is illustrated with its sides substantially parallel with the sides of the top part 6 of the carton 5 but it could be rotatably oriented in any direction desired. The trays 34 can be removed from the carton 5 and placed in a single stack for display in the same manner as above described in the single wrapper embodiment with the additional steps of folding the flaps 23 and 24 to form handles in wrapper 20, removing the lower wrapper 20 and its contents from the carton part 7 and placing it on top and in alignment with the trays 34 from the upper wrapper 28 that are sitting on the upper surface of carton part 6, and horizontally slidably removing the wrapper 20 while maintaining the orientation of the two stacks of trays. Although use of both the plug 57 and the stop 58 are illustrated, it is understood that either could be used alone. If just the plug 57 is used, the sign will be at an elevation fixed by the placement of the plug 57. When the stop 58 is used and initially placed between the uppermost two trays 34 in the stack, as the merchandise and trays are removed, the upper tube 54 and the sign 46 will automatically adjust downwardly as the tray 34 that is directly below the stop 58 is depleted of merchandise and removed, the stop 58 falling downwardly to be supported by next lower tray 34.

When in the fully packed configuration, the two lift wrapper with sign embodiment is fully self contained. The merchandise trays 34 are stacked, part within the upper wrapper 28 and the balance within the lower wrapper 20. The U-shaped relief 59 in the upper wrapper 28, the U-shaped relief 51 in the lower wrapper 20 and the channel 39 in each tray 34 are of substantially the same width and register laterally resulting in a vertical cavity within which can be shipped the sign post tubes 54 and 55 and the plug 57. The stop 58 is extremely thin and can be located virtually anywhere in the inside surface of the carton 5.

In the preferred embodiments, the outside carton and the lift wrappers are constructed of corrugated cardboard. However, other like materials are within the contemplation of the invention. The tray modules could be made from cardboard, plastic or metal, depending upon the nature of the merchandise being contained and the life expectancy desired from the container.

The present invention provides a container for shipping and storage constructed of light weight relatively inexpensive materials that are structurally sound; the invention further allows rapid packing, unpacking, repacking and setting up of an extremely simple self contained display. Each lift wrapper holds the stack of merchandise trays as a single unit, allowing unpacking of the carton and setting up of a neat, preplanned display in a few motions.

The embodiments of the invention in which an exclusive property or privilege is claimed are defined as follows:

1. A merchandise container comprising: an outer carton; a plurality of merchandise trays disposed in stacked relationship within said carton; and at least one wrapper of sheet material, each having a bottom and opposed side portions terminating in integrally hinged flaps, each wrapper being disposed around a portion of said stacked trays, the side portions of each wrapper being of such height as to enclose said portion of stacked trays disposed within and permitting said flaps to fold over the top of said portion of stacked trays, the cumulative height of said side portions of said wrappers substantially filling said carton, wherein some of said wrappers have registering apertures formed in their flaps and side portions and the other said wrappers have pairs of registering apertures formed in their flaps which straddle a fold line which divides each flap, said apertures to act as a double-walled reinforced handle to permit the wrapper and trays disposed within to be lifted from the carton.

2. A merchandise container as defined in claim 1 further comprising at least one advertising sign, sign support means and sign adjustment means.

3. A merchandise container as defined in claim 2 wherein said sign, support means and adjustment means are within said carton during shipment thereof.

4. A merchandise container as defined in claim 1 wherein at least one of said wrappers further comprises means for reconfiguring said wrapper into a sign.

5. A merchandise container as defined in claim 4 wherein said wrapper having means for reconfiguration further comprises suitable printed advertising indicia, visible when said wrapper functions as said sign.

6. A merchandise container as defined in claim 2 wherein said plurality of trays each comprise means for supporting said sign support means.

7. A merchandise container as defined in claim 2 wherein said sign adjustment means comprises a plug and a sliding stop which cooperate to determine the vertical height of the sign support means whereby said sign support means varies in vertical height as a function of the amount of merchandise and trays remaining in the stack, the sign support means and sign lowering as the merchandise and trays remaining in the stack are depleted.

8. A merchandise container as defined in claim 1 wherein the lift wrappers are constructed of corrugated cardboard and the hinges and fold lines are scored lines in the cardboard.

9. A merchandise container as defined in claim 1 wherein said outer carton comprises two interfitting parts wherein said one carton part is smaller than the other said carton part in horizontal cross-section, the parts fitting together telescopingly.

10. A merchandise container comprising: an outer carton; a plurality of merchandise boxes disposed in stacked relationship within said carton; and at least one lift wrapper of sheet material, each having a bottom and opposed side portions terminating in integrally hinged flaps, each wrapper being disposed around a portion of said stacked boxes, the side portion of each wrapper being of such height as to enclose said portion of stacked boxes disposed within and permitting said flaps to fold over the top of said portion of stacked boxes, the cumulative height of said side portions of said wrappers substantially filling said carton, wherein some of said wrappers have registering apertures formed in their flaps and side portions and the other said wrappers have pairs of registering apertures formed in their flaps which straddle a fold line which divides each flap, said apertures to act as a double-walled reinforced handle to permit the wrapper and boxes disposed within to be lifted from the carton.

11. A merchandise container as defined in claim 10 wherein the lift wrappers are constructed of corrugated cardboard and the hinges and fold lines are scored lines in the cardboard.

12. A merchandise container as defined in claim 10 wherein said outer carton comprises two interfitting parts wherein said one carton part is smaller than the other said carton part in horizontal cross-section, the parts fitting together telescopingly.

13. A merchandise container as defined in claim 10 further comprising a plurality of planar spacers, said spacers being horizontally interposed between tiers of said stack of merchandise boxes, thereby lending cohesiveness to said stack of boxes upon removal of said stack from the carton.

14. A merchandise container comprising: an outer carton; a plurality of merchandise trays disposed in stacked relationship with said carton; and at least one lift wrapper of sheet material, each having a bottom and opposed side portions, each wrapper being disposed around a portion of said stacked trays, the side portions of each wrapper being of such height as to enclose said portion of stacked trays disposed within, the cumulative height of said side portions of said wrappers substantially filling said carton, wherein each side portion of each said wrapper has an aperture formed therein, said apertures to act as handles to permit the wrapper and trays disposed within to be lifted from the carton.

15. A merchandise container as defined in claim 14 wherein said outer carton comprises two interfitting parts wherein said one carton part is smaller than the other said carton part in horizontal cross-section, the parts fitting together telescopingly.

16. A merchandise container as defined in claim 14 further comprising at least one advertising sign, sign support means and sign adjustment means.

17. A merchandise container as defined in claim 16 wherein said sign, support means and adjustment means are within said carton during shipment thereof.

18. A merchandise container as defined in claim 14 wherein at least one of said wrappers further comprises means for reconfiguring said wrapper into a sign.

19. A merchandise container as defined in claim 18 wherein said wrapper having means for reconfiguration further comprises suitable printed advertising indicia, visible when said wrapper functions as said sign.

20. A merchandise container as defined in claim 16 wherein said plurality of trays each comprise means for supporting said sign support means.

21. A merchandise container as defined in claim 16 wherein said sign adjustment means comprises a plug and a sliding stop which cooperate to determine the vertical height of the sign support means whereby said sign support means varies in vertical height as a function of the amount of merchandise and trays remaining in the stack, the sign support means and sign lowering as the merchandise and trays remaining in the stack are depleted.

22. A merchandise container as defined in claim 14 wherein the lift wrappers are constructed of corrugated cardboard.

23. A merchandise container comprising: an outer carton; a plurality of merchandise boxes disposed in stacked relationship within said carton; and at least one lift wrapper of sheet material, each having a bottom and opposed side portions, each wrapper being disposed around a portion of said stacked boxes, the side portion of each wrapper being of such height as to enclose said portion of stacked boxes disposed within, the cumulative height of said side portions of said wrappers substantially filling said carton, wherein each side portion of each said wrapper has an aperture formed therein, said apertures to act as handles to permit the wrapper and boxes disposed within to be lifted from the carton.

24. A merchandise container as defined in claim 23 wherein said carton comprises two interfitting parts wherein said one carton part is smaller than the other said carton part in horizontal cross-section, the parts fitting together telescopingly.

25. A merchandise container as defined in claim 23 further comprising a plurality of planar spacers, said spacers being horizontally interposed between tiers of said stack of merchandise boxes, thereby lending cohesiveness to said stack of boxes upon removal of said stack from the carton.

26. A merchandise container as defined in claim 25 wherein said wrappers and spacers are constructed of corrugated cardboard.

27. A method of packing and unpacking merchandise comprising the steps of: placing a folded wrapper having two apertures in each of its vertical sides within an open top carton part with the sides of the wrapper extending substantially above the sides of the carton part; stacking trays of merchandise on top of one another within the carton part and wrapper to a height substantially filling the carton part but below the height of the wrapper; folding the wrapper over the top of the trays; and placing a second carton part over the first part to enclose the trays and wrapper.

28. A method of packing and unpacking merchandise as defined in claim 27 further comprising the steps of: removing the second carton part to expose the trays and wrapper; unfolding the wrapper outwardly from over the top of the trays until the two apertures in each side of the wrapper register forming handles; and removing the wrapper and merchandise trays as a single unit from the open top carton part.

* * * * *